United States Patent [19]

Forsberg

[11] 4,106,154

[45] Aug. 15, 1978

[54] ADHESIVE APPLICATOR DEVICE

[75] Inventor: Charles W. Forsberg, Shaker Heights, Ohio

[73] Assignee: Indian Head Inc., New York, N.Y.

[21] Appl. No.: 686,136

[22] Filed: May 13, 1976

[51] Int. Cl.[2] ..... A47L 13/46; B05C 17/00

[52] U.S. Cl. ..... 15/244 R; 15/104.16; 15/211

[58] Field of Search ..... 15/154, 211, 244 R, 15/209 D, 104.16, 104.165; 401/128–130, 9; 128/269; D7/179; 294/99 R

[56] References Cited

U.S. PATENT DOCUMENTS

| | | | |
|---|---|---|---|
| 127,230 | 5/1872 | Fellows | 294/99 R X |
| D. 180,355 | 5/1957 | Blackburn | D7/179 |
| D. 184,418 | 2/1959 | Brownstein | D7/179 |
| D. 186,157 | 9/1959 | Whamond | D7/179 |
| 673,621 | 5/1901 | Moody et al. | 15/244 R |
| 1,371,790 | 3/1921 | Kelly | 15/154 UX |
| 2,755,497 | 7/1956 | Graecen | 401/200 |
| 2,828,502 | 4/1958 | Tupper | 15/211 |
| 3,214,778 | 11/1965 | Mathison | 15/154 X |
| 3,226,754 | 1/1966 | Brittain | 401/130 |
| 3,228,398 | 1/1966 | Leonard et al. | 128/269 |
| 3,581,745 | 6/1971 | Eller | 294/99 R X |
| 3,777,760 | 12/1973 | Essner | 128/269 |
| 3,951,157 | 4/1976 | Idec | 401/130 |

FOREIGN PATENT DOCUMENTS

| | | | |
|---|---|---|---|
| 766,796 | 1/1957 | United Kingdom | 15/210 R |

*Primary Examiner*—Daniel Blum
*Attorney, Agent, or Firm*—William R. Laney

[57] ABSTRACT

An adhesive applicator device including an elongated shaft having a bifurcated end portion and a handle secured thereto at its end opposite the bifurcated end portion. A porous resilient applicator pad is pressed into the bifurcation in the bifurcated portion of the shaft, and includes a central pad portion disposed between the portions of the shaft defining the bifurcation, and a pair of spaced adhesive applicator portions disposed on opposite sides of the central pad portion and exposed to facilitate application of adhesive from the outer peripheral surface of the pad to an object in contact therewith.

4 Claims, 6 Drawing Figures

ADHESIVE APPLICATOR DEVICE

RELATED APPLICATION

This application is related to my copending patent application ser. No. 547,391 filed on Feb. 6, 1975 and entitled "ADHESIVE APPLICATOR DEVICE AND METHOD", now U.S. Pat. No. 3,966,334.

BACKGROUND OF THE INVENTION

1. Field of the Invention

This invention relates to manual applicator devices for applying an adhesive to an object, and more particularly, to dauber-type, manual adhesive applicators in which adhesive is transferred to the surface of an object from a swab or dauber pad carrying the adhesive.

2. Brief Description of the Prior Art

In my copending application Ser. No. 547,391, now U.S. Pat. No. 3,966,334, I illustrate and describe an adhesive applicator device which is especially well adapted for applying an adhesive to a cylindrical object. The adhesive applicator device shown and described in my prior application includes a central shaft of X-shaped cross-section which is projected into a generally cylindrical applicator pad of cellular porous resilient material. The pad is thus retained against rotation on the shaft by reason of its X-shaped cross-sectional configuration.

Although the adhesive applicator device as thus constructed performs very well in the application of an adhesive to the interior and exterior surfaces of tubular or cylindrical members, such as pipe, of medium or large diameter, with very small fittings the applicator is difficult to insert in the interior of such fittings, and the foam pad of the applicator device will compress during insertion and the adhesive will be wiped off the applicator device at the point of insertion. This results in an inadequate amount of adhesive being available to the interior surface of the fitting.

Brief Description of the Present Invention

The present invention provides an adhesive applicator device which possesses capabilities of usage not possessed by the adhesive applicator device described in my copending application, and constitutes, for some applications, an improvement with respect to the previously described applicator device. Basically, the adhesive applicator device of the present invention primarily adapted for usage in relativey small diameter fittings and conduit for applying an adhesive to the interior or exterior cylindrical surfaces of such structures. The applicator device is specifically constructed to attain sufficient strength in the shaft forming a part of the device to prevent fracturing or breakage of the shaft, but will yet afford adequate applicator pad surface to efficiently apply the adhesive over the surfaces of such small diameter tubing and conduit.

Broadly described, the adhesive applicator device of the present invention comprises an elongated shaft having a handle secured to one end thereof, and carrying at its end opposite the handle, a bifurcated end portion. A porous resilient applicator pad is mounted on the shaft by extension into the space defined at the bifurcated end portion thereof. The porous resilient applicator pad, when detached from the shaft and in its relaxed state, is of generally cylindrical configuration. When mounted on the shaft, the applicator pad includes a central portion, which is disposed between those parts of the shaft which define the bifurcation at the bifurcated end portion, and a pair of spaced, lateral adhesive applicator portions disposed on opposite sides of the central portion of the pad.

In a preferred embodiment of the invention, the shaft, including the bifurcated portion thereof, and the handle are integrally formed and are preferably molded of a suitable synthetic resin. It is further preferred that the major portion of the shaft extending between the handle and the bifurcated end portion thereof be of X- or cross-shaped configuration. Finally, the preferred embodiment of the invention includes a bifurcated end portion made up of a pair of spaced, substantially parallel legs which define the bifurcation at one end of the shaft, which legs each have one or more pointed tines projecting into the bifurcation thereof, and impaling the central portion of the porous resilient applicator pad.

An important object of the invention is to provide an adhesive applicator device which is of sturdy construction and functions, in use, to efficiently apply adhesive.

Another object of the present invention is to provide an adhesive applicator device which can be used to apply a thin, smooth layer of adhesive to the exterior surfaces of small pipe and conduit, and particularly, though without limitation, to the interior surface of a small fitting adjacent one open end thereof.

An additional object of the present invention is to provide an adhesive applicator device which is capable of relatively high loading with a liquid or semi-liquid adhesive, and which can be used to supply such adhesive, through a porous applicator pad forming a portion of the device, to surfaces contacted by said pad.

Additional objects and advantages of the invention will become apparent as the following detailed description of the invention is read in conjunction with the accompanying drawings which illustrate the invention.

GENERAL DESCRIPTION OF THE DRAWINGS

DETAILED DESCRIPTION OF A PREFERRED EMBODIMENT OF THE INVENTION

Figure 1:
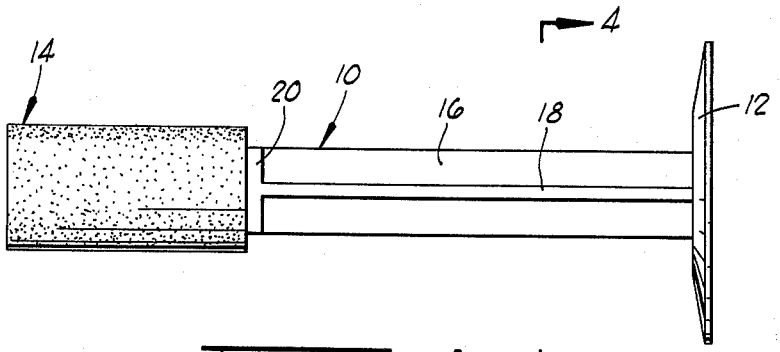
FIG. 1 is a side elevation view of a preferred embodiment of an adhesive applicator device constructed in accordance with the present invention.
Figure 2:
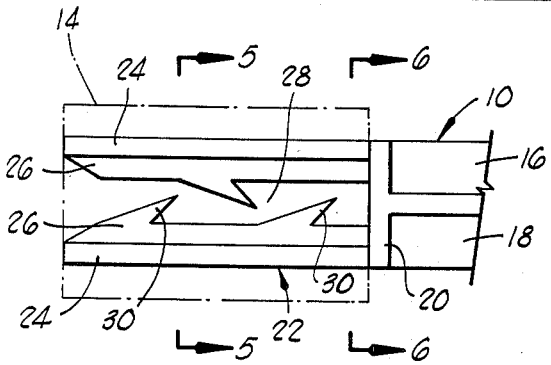
FIG. 2 is a detail view illustrating, in solid lines, a bifurcated end portion of the adhesive applicator device, and showing in dashed lines, a porous resilient applicator pad which is engaged by the bifurcated end portion in the final construction of the device.

Referring initially to the drawings, and particularly to FIG. 1 thereof, the adhesive applicator device of the invention includes an elongated shaft designated generally by reference numeral 10, a handle 12 secured to one end of the shaft and a porous resilient applicator pad designated generally by reference numeral 14 which is carried on the end of the shaft opposite its end secured to the handle 12. In a preferred embodiment of the invention, the shaft 10 and the handle 12 constitute an integral, unitary structural element, and are preferably formed by molding from a suitable synthetic resin.

The shaft 10 includes an elongated portion adjacent the handle 12 which is of an X- or cross-shaped cross-section. Thus, in the illustrated embodiment of the invention, this portion of the handle 10 includes a pair of intersecting flanges or webs 16 and 18 which extend normal to each other and intersect at the midportions of each other. The flanges 16 and 18, in the illustrated embodiment, define right angles along their line of intersection, but it is to be understood that in other forms of the invention, this portion of the shaft 10 can be variously shaped or configured. The flanges 16 and 18 extend from the handle 12 at one end of the shaft 10 to a generally rectangular or a square abutment plate 20. On the opposite side of the abutment plate 20 from the flanges 16 and 18, the shaft includes a bifurcated end portion designated generally by reference numeral 22.

The bifurcated end portion 22 includes a pair of generally parallel, spaced legs of T-shaped cross-section. Each leg includes a first web 24 and an inwardly projecting second web 26 which extends normal to the first web, and is secured thereto along a medial plane of the first web. Th parallel spaced legs define a gap or space 28 between them, and each of the webs 26 has one or more barbs or tines 30 which project into the space 28. Each of the tines 30 is inclined in a direction away from the end of the shaft 10 and toward the abutment plate 20, and it will be further noted that the tines 30 projecting from the web 26 of one leg project past or overlap the tines projecting from the other web, and that the tines projecting from the respective legs of the bifurcated end portion 22 are staggered along the bifurcation-defining legs in relation to those projecting from the other of the legs.

Figure 3:
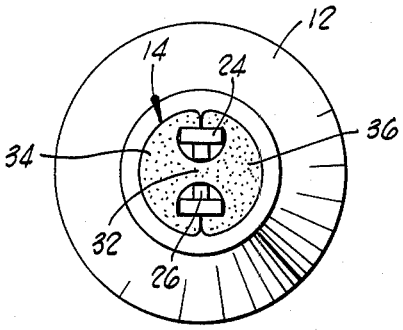
FIG. 3 is an end view of the preferred embodiment of the adhesive applicator device of the invention as illustrated in FIG. 1.
Figure 4:
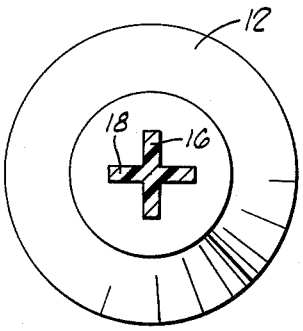
FIG. 4 is a sectional view taken along line 4—4 of FIG. 1.
Figure 5:
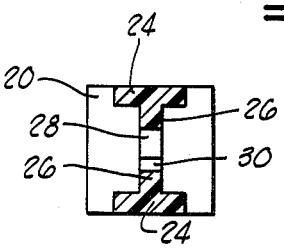
FIG. 5 is a sectional view taken along line 5—5 of FIG. 2.
Figure 6:
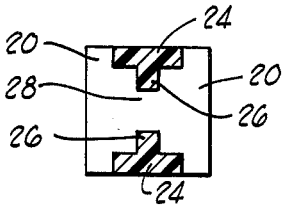
FIG. 6 is a sectional view taken along line 6—6 of FIG. 2.

The resilient porous applicator pad 14 is constructed of a sponge-like, open-celled synthetic resin material, and in its relaxed state is generally cylindrical in configuration. As it is used in the adhesive applicator device of the present invention, however, it is centrally compressed so that a central portion 32 thereof is pressed into the space 28 betweeen the opposed parallel legs forming the bifurcated end portion 22 of the shaft 10. Those side portions of the porous pad on opposite sides of the central portion 32 then assume a generally semi-cylindrical configuration, and these side portions, designated by reference numerals 34 and 36, flare out around the legs of the bifurcated end portion 22. When the pad 14 is thus positioned in the bifurcated end portion 22, it assumes a panduriform configuration as illustrated in FIG. 3.

It will be perceived that a generally cylindrical outer peripheral surface characterizes the exposed outer side of the porous pad 14, and it is from this surface that adhesive is applied by the use of the applicator device. It will further be understood that when the porous applicator pad 14 is pressed into the engaged position depicted in FIGS. 1 and 3, the tines 30 bite into and engage the central portion 32 of the pad, and retain it in position on the bifurcated end portion 22 of the shaft 10 during use of the adhesive applicator device.

In the use of the adhesive applicator device, the device can be placed in a jar or other container of adhesive with the handle 12 functioning as a lid for the container. In this respect, the handle 12 can be altered in its configuration so as to form a screw lid for such container if desired. While it is in position in the adhesive-containing jar or receptacle, adhesive tends to infiltrate and saturate the porous resilient pad 14 by a wicking action.

In the course of usage, the applicator device is removed from the adhesive-containing receptacle and, while holding the handle 12 between the fingers, the pad 14 is caused to bear tangentially against the peripheral surface, either inner or outer, of a fitting, tubular member or conduit to which adhesive is to be applied. The pad is then moved around the cylindrical surface with which it is in contact without rotating the pad — that is, as the pad is moved around the cylindrical surface to which adhesive is to be applied, that cylindrical surface comes in contact with a continuously changing line of contact on the pad, and thus fresh adhesive is distributed on the cylindrical surface from the entire outer peripheral surface of the pad as it is moved around such cylindrical surface.

An important feature of the present invention is the construction of the shaft 10 and the manner of attachment thereto of the porous pad 14. This construction permits adequate structural strength to be maintained in the shaft 10 to prevent fracturing, while concurrently permitting a small functional resilient porous pad to be engaged firmly with the shaft.

Although a preferred embodiment of the invention has been herein described in order to demonstrate the principles of the invention, it is to be understood that various changes and innovations in the precisely illustrated and described structure can be effected without departure from such basic principles. Changes and innovations of this type are therefore deemed to be circumscribed by the spirit and scope of the invention except as the same may be necessarily limited by the appended claims or reasonable equivalents thereof.

What is claimed is:

1. A device for applying adhesive to a cylindrical surface comprising:

an elongated shaft bifurcated at one end thereof and having a cross-shaped cross-sectional configuration over a major portion of its length, said shaft further including barbs projecting into the bifurcation at said one end of the shaft with the barbs on opposite sides of the bifurcation staggered and in overlapping relation to each other;

an abutment plate interposed between said bifurcated end and the cross-shaped cross-sectional portion of said shaft and lying substantially in a plane extending normal to the axis of said shaft;

a handle integrally formed with the shaft on its end opposite its bifurcated end; and a panduriform applicator pad retained in the bifurcation of the shaft and flaring out around the shaft adjacent said bifurcated end, said pad being impaled upon said barbs and abutting said abutment plate.

2. An adhesive applicator pad device comprising:

an elongated shaft having a first end and a second end and further including:

a first portion having an X-shaped cross-section adjacent said first end, said first portion including a pair of intersecting flanges;

a second portion adjacent said second end and including pad retention means on said second portion, said pad retention means comprising:

a pair of spaced, substantially parallel legs each terminating at said second end, and each having a T-shaped cross-section; and a plurality of barbs on said legs and each projecting into the space therebetween with the barbs on opposite ones of said legs being offset in an axial direction with respect to the barbs on the other of said legs; and an abutment plate positioned between said first portion and said second portion and lying in a plane extending normal to the axis of said shaft;

a handle secured across the first end of the shaft and formed integrally with the shaft; and a resilient adhesive applicator pad including a central portion impaled upon said barbs and extending into the space between said substantially parallel legs, and said resilient adhesive applicator pad having an end abutted against said abutment plate and an end extending to the second end of said shaft.

3. A device for applying adhesive to a cylindrical surface comprising:

an elongated shaft bifurcated at one end thereof and further including rearwardly directed barbs projecting into the bifurcation at said one end of the shaft with the barbs on opposite sides of the bifurcation staggered and in overlapping relation to each other;

an abutment plate interposed between said bifurcated end and the remaining portion of said shaft extending to the end thereof opposite said bifurcation, said abutment plate lying substantially in a plane extending normal to the axis of said shaft;

a handle integrally formed with the shaft on its end opposite its bifurcated end; and a panduriform applicator pad retained in the bifurcation of the shaft and flaring out around the shaft adjacent said bifurcated end, said pad being impaled upon said barbs and abutting said abutment plate.

4. An adhesive applicator pad device comprising:

an elongated shaft having a first end and a second end and further including:

a first portion adjacent said first end;

a second portion adjacent said second end and including pad retention means on said second portion, said pad retention means comprising:

a pair of spaced, substantially parallel legs each terminating at said second end, and each having a T-shaped cross-section; and a plurality of rearwardly directed barbs on said legs and each projecting into the space therebetween with the barbs on opposite ones of said legs being offset in an axial direction with respect to the barbs on the other of said legs; and abutment means positioned between said first portion and said second portion and lying in a plane extending normal to the axis of said shaft;

a handle secured across the first end of the shaft and formed integrally with the shaft; and a resilient adhesive applicator pad including a central portion impaled upon said barbs and extending into the space between said substantially parallel legs, and said resilient adhesive applicator pad having a first end abutted against said abutment means and a second end extending to the second end of said shaft.

* * * * *